US008209831B2

(12) United States Patent
Boehm et al.

(10) Patent No.: US 8,209,831 B2
(45) Date of Patent: Jul. 3, 2012

(54) SURFACE CONDITIONING FOR THERMAL SPRAY LAYERS

(75) Inventors: Jens Boehm, Neuhausen (DE); Michael Gruener, Bad Ueberkingen (DE); Martin Hartweg, Erbach (DE); Tobias Hercke, Waldenbuch (DE); Karl Holdik, Ulm (DE); Patrick Izquierdo, Ulm (DE); Wolfgang Pellkofer, Ulm (DE); Dezsoe Schilling, Hemmingen (DE)

(73) Assignee: Daimler AG, Stuttgart (DE)

( * ) Notice: Subject to any disclaimer, the term of this patent is extended or adjusted under 35 U.S.C. 154(b) by 788 days.

(21) Appl. No.: 12/162,351

(22) PCT Filed: Jan. 19, 2007

(86) PCT No.: PCT/EP2007/000450

§ 371 (c)(1),
(2), (4) Date: Dec. 1, 2008

(87) PCT Pub. No.: WO2007/087989

PCT Pub. Date: Aug. 9, 2007

(65) Prior Publication Data

US 2009/0175571 A1 Jul. 9, 2009

(30) Foreign Application Priority Data

Feb. 2, 2006 (DE) ..... 10 2006 004 769

(51) Int. Cl.
*B21C 37/30* (2006.01)
*F16C 17/02* (2006.01)

(52) U.S. Cl. ..... 29/90.01; 384/625

(58) Field of Classification Search ..... 29/90.01, 29/89.5, 90.2, 90.7, 421.1, 459, 460; 384/625; 427/444, 455; 428/141
See application file for complete search history.

(56) References Cited

U.S. PATENT DOCUMENTS

| | | | | |
|---|---|---|---|---|
| 4,817,342 | A * | 4/1989 | Martin et al. | 451/90 |
| 5,380,564 | A | 1/1995 | VanKuiken, Jr. et al. | |
| 5,455,078 | A | 10/1995 | Kanzaki | |
| 5,622,753 | A | 4/1997 | Shepley et al. | |
| 5,626,674 | A | 5/1997 | VanKuiken, Jr. et al. | |
| 5,648,122 | A | 7/1997 | Rao et al. | |
| 2002/0146541 | A1 | 10/2002 | Fried | |
| 2003/0209288 | A1 | 11/2003 | Huang | |
| 2005/0036892 | A1 | 2/2005 | Bajan | |

FOREIGN PATENT DOCUMENTS

DE 19523900 C1 1/1997

(Continued)

OTHER PUBLICATIONS

International Search Report dated Nov. 4, 2007.

*Primary Examiner* — John C Hong
(74) *Attorney, Agent, or Firm* — Patent Central LLC; Stephan A. Pendorf

(57) ABSTRACT

The invention relates to a process for roughening metal surfaces to improve adhesion of layers which are thermally sprayed thereon, in that in a first process step recesses or depressions (2) are introduced into the surface in a material-detaching or material-removing treatment so that the protruding metal of the surface forms raised microstructures (3), in particular projections, ridges, protuberances or bumps, these microstructures being reworked in at least a second process step by shaping and/or breaking so that a significant proportion of the structures form undercuts (4) in relation to the surface.

15 Claims, 2 Drawing Sheets

FOREIGN PATENT DOCUMENTS

| | | | |
|---|---|---|---|
| DE | 19713519 | A1 | 11/1997 |
| DE | 19750687 | A1 | 5/1999 |
| DE | 10014486 | A1 | 10/2001 |
| DE | 10057187 | A1 | 5/2002 |
| EP | 0568315 | A1 | 11/1993 |
| EP | 0 618 040 | A1 | 5/1994 |
| EP | 0 704 271 | A1 | 3/1996 |
| EP | 0750054 | A1 | 12/1996 |
| EP | 0 568 315 | A1 | 6/1997 |
| EP | 1 225 324 | A2 | 7/2002 |
| EP | 1 247 874 | A1 | 10/2002 |
| EP | 1 507 018 | A1 | 2/2005 |
| GB | 631362 | A | 11/1949 |
| GB | 1015036 | A | 12/1965 |
| GB | 2222179 | A | 2/1990 |
| JP | 61223175 | A | 10/1986 |
| JP | 6297331 | A | 10/1994 |
| JP | 2005194938 | A | 7/2005 |
| WO | 2006061710 | A1 | 6/2006 |

* cited by examiner

SURFACE CONDITIONING FOR THERMAL SPRAY LAYERS

The invention relates to processes for roughening metal surfaces to improve adhesion of layers which are thermally sprayed thereon, in particular to the preparation of surfaces in the thermal coating of the inside of cylinder bores and metallic motor vehicle components which have a roughened surface and are suitable for the deposition of thermal spray layers.

If thermal spray layers are deposited onto metallic substrates, the high differences in temperature between the spray layer and the substrate generally give rise to high mechanical tensions which adversely affect the layer adhesion. In the conventional thermal spraying processes such as plasma spraying, flame spraying, high-speed flame spraying or arc wire spraying, the spray particles are deposited onto the cold substrate in the molten state and quenched at a high cooling rate.

The differing mechanical and thermal properties of the layer and substrate, in particular under high mechanical or thermal loads, also have an adverse influence on layer adhesion. Common wear protection layers can contain ceramic material, such as $Al_2O_3$, SiC, TiC or WC, which has only low physical compatibility with the metal of the substrate.

However, even purely metallic layers, such as are conventionally used as track coatings of pistons in internal combustion engines, tend to become detached under the extreme conditions prevailing in the internal combustion engine.

Very high demands are placed on adhesive strength, for example in the running faces of cylinders in internal combustion engines.

Improving the adhesion of thermal spray layers generally requires roughening of the substrate surface. This increases the surface area of contact between the substrate material and layer material and also causes a certain degree of mechanical clamping.

Sandblasting, grinding or precision turning or machining are particularly important as roughening processes.

A blasting process is known from DE 195 08 687 C2 which discloses a thermal spraying process in which reference is made, for pretreating the inside of cylinder bores made of cast aluminum alloy, to blasting with cold scrap iron or another suitable abrasive material such as aluminum oxide.

The publications "INDUSTRIE-Anzeiger" 34, 35/97, "Hartdrehen statt Feinschleifen", p. 48, "Maschine und Werkzeug" 6/95 "Hartdrehen überholt Feinschleifen", pp. 57-61 and also Pfeiffer, F. "Höhere Sphären" in: "Maschinenmarkt", Würzburg 101 (1995), pp. 2, 46-49 disclose processes for the furnishing of workpieces by rotary milling or hard turning, i.e. the production of surfaces of particularly high quality. The processes described therein serve as a substitute for grinding or for a process with which a particularly smooth surface having low Rz values is achieved.

DE 198 401 17 C2 discloses a process for surface-working the inside of cylinder bores as preparation for the application of a thermally sprayed layer, a portion of the material forming the inside being removed by dry machining without lubricant and a surface having a defined structure and/or quality with a Rz value of from 25 to 65 μm being formed. The machining can be carried out by way of spindle cutting, brushing, knurling, circular milling or combinations of one or more of these processes.

A process for preparing the surface of cylinder bores is known from WO 02/40850 A1. Surface roughening is carried out by means of double chip-detaching machining. In this case, coarse ridge or wave structures are generated and finer ridge or wave structures incorporated therein.

The known processes for pretreating or conditioning surfaces are no longer adequate for achieving sufficient adhesive strength of thermally sprayed layers under alternating thermal loads and mechanical stresses.

The object of the invention is to provide a process for the conditioning of metallic surfaces to improve the adhesiveness of thermal spray layers deposited thereon and also to provide coated components having high layer adhesion.

According to the invention, the object is achieved by a process for roughening metal surfaces to improve adhesion of layers which are thermally sprayed thereon, in that in a first process step recesses or depressions (2) are introduced into the surface in a material-detaching or material-removing treatment so that the protruding metal of the surface forms raised microstructures (3), in particular projections, ridges, protuberances or bumps, having the features of claim 1, by a metallic motor vehicle component having a roughened surface, which is suitable for the deposition of thermal spray layers, having the features of claim 13, and also by a metallic motor vehicle component having a thermally sprayed tribological or wear protection layer, having the features of claim 15.

The invention thus provides a multistage process for treating surfaces. In a first process step recesses or depressions are introduced into the surface in a material-detaching or material-removing treatment. As a result, the protruding metal of the surface forms raised microstructures, in particular projections, ridges, protuberances or bumps. According to the invention, this was followed by at least one further process step leading to undercut structures. In the second process step the raised microstructures are reworked by shaping and/or breaking so that a significant proportion of the structures form undercuts in relation to the surface. The second process step can also include removal of material, although only comparatively little material is removed compared to the first process step.

The undercuts allow very good and effective mechanical clamping of the subsequently deposited coating to be achieved. As the spray particles of the thermal spray layer are substantially still liquid during deposition, they can also be deposited in the undercut regions. Even a small proportion of coating material in the undercut volume leads in this case to a highly significant increase in adhesive strength. The effect of the undercuts is particularly important in the deposition of the thermal spray layers, as the cooling of the layers is also accompanied by marked contraction of the layer material. The undercuts markedly impede the layer material from shrinking away from the substrate surface; this significantly improves adhesion.

Even a low proportion of undercut structures display the effect according to the invention of improved surface adhesion of the layer. Preferably at least 5% of the raised microstructures have at least one undercut region. Particularly preferably more than 50% of the microstructures have undercuts. The total undercut surface area in the plane parallel to the metal surface is preferably at least 3%, particularly preferably more than 5%.

With regard to the introduction of the raised microstructures in the first process step, the conventional processes for roughening metallic surfaces are in principle suitable. These include for example machining by way of spindle cutting, brushing, knurling, circular milling or similar processes. Sandblasting is also suitable.

A further suitable process is highly-pressure water jet machining, in particular high-pressure water jet machining with abrasive particles.

Whereas the first process step leads to removal of material, the second process step is designed in such a way that only small amounts of material or if possible no material at all is now removed from the substrate. The second process step seeks to change the shape of the microstructures to the extent that new undercuts are formed.

The second process step can also optionally be followed by further steps which lead to further forming of undercuts or bring about smoothing of the surface.

The invention will be described by way of example in greater detail with reference to schematic drawings and photomicrographs.

Figure 7:
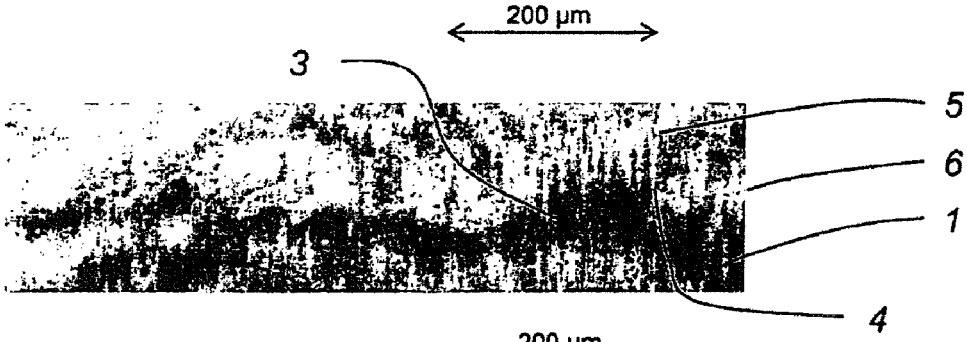
Figure 8:
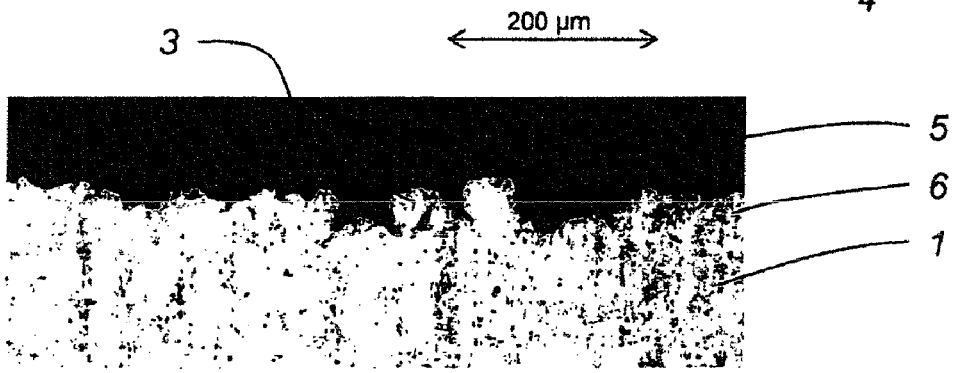

FIG. 7 is a micrograph of a metallic motor vehicle component transversely to the surface (1) with a thermally sprayed tribological or wear protection layer (5), with a penetration layer (6), microstructures (3) and undercuts (4); and FIG. 8 is a micrograph of a metallic motor vehicle component transversely to the surface (1) with a thermally sprayed tribological or wear protection layer (5), with a penetration layer (6) and mushroom- or pushbutton-shaped microstructures (3).

In a preferred configuration of the second process step the surface, which has been roughened by the first process step, is exposed to rolling, pressing or blasting with solid and/or liquid media.

Figure 3:
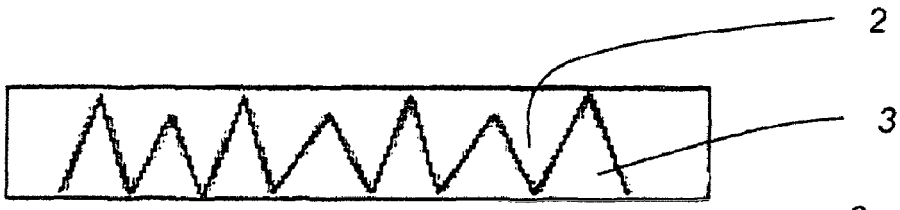
FIG. 3 shows a metallic surface (1) with recesses or depressions (2) and raised microstructures (3) after the first process step.
Figure 4:
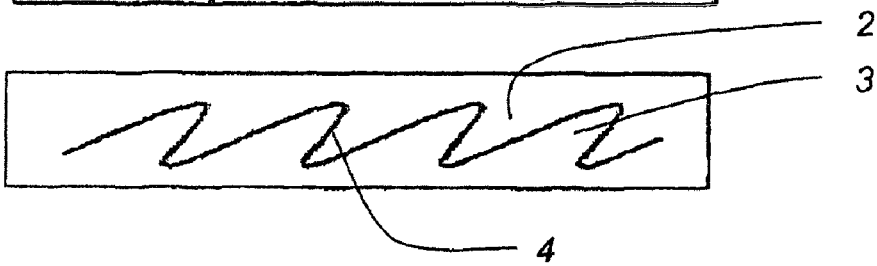
FIG. 4 shows a metallic surface (1) after the second process step with recesses or depressions (2) and raised microstructures (3) having undercuts (4) in the form of curved tips.

One of the possible repercussions of this second process step is shown schematically in FIG. 4. In the first process step ridges are introduced into the surface (FIG. 3). This is followed by lateral bending-over of the raised microstructures (3) in ridge form. This is carried out for example by a rolling process. A preferred orientation of bent-over or kinked microstructures can likewise also be produced by obliquely acting blasting processes or pressing processes.

Blasting is in this case particularly suitable to bring about bending-over or kinking of the raised structures that is distributed uniformly in all directions. Suitable blasting media include for example fine globular powders having low abrasive effect, in particular as shot blasting.

It is also possible to carry out the blasting of the second process step under mild abrasive conditions, for example by sandblasting, or highly-pressure water jet machining or high-pressure water jet machining with abrasive particles. The mean particle size of the abrasive particles should in this case preferably be in the same order of magnitude as or finer than the coarse depth of the surface to be blasted. Preferably this does not increase the coarse depth; on the contrary, the surface of the microstructures is even roughened.

In a further configuration of the invention, the undercuts of the second process step are formed by thermal processes. A heat treatment of the surface, which leads to melting of the tips of the microstructures, is in this case carried out as the second process step.

Figure 1:
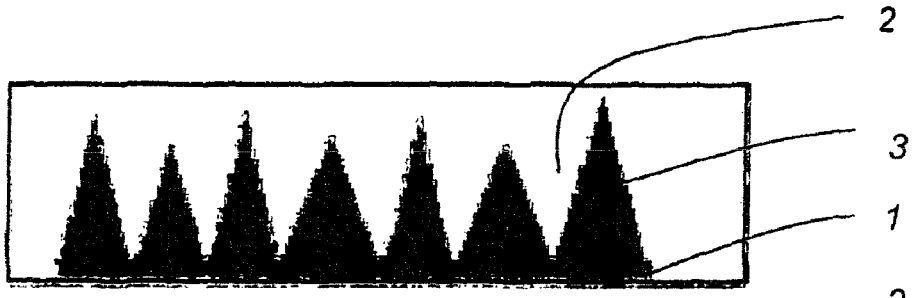
FIG. 1 shows a metallic surface (1) with recesses or depressions (2) and raised microstructures (3) after the first process step.
Figure 2:
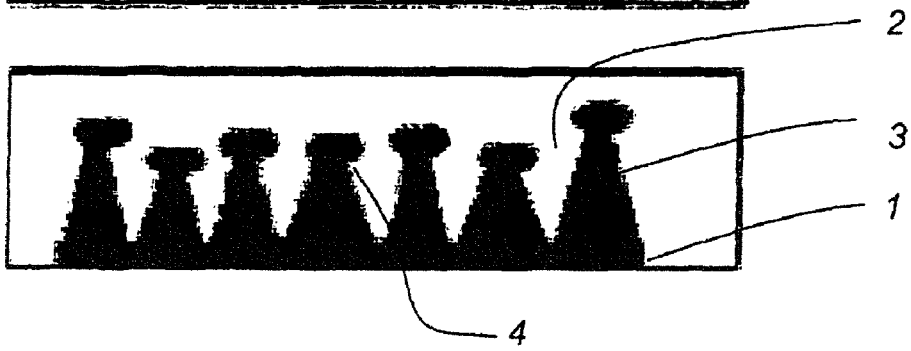
FIG. 2 shows a metallic surface (1) after the second process step with recesses or depressions (2) and raised microstructures (3) having undercuts (4) in the form of widened tips.

The effect of this variation of the process is represented by way of example in FIG. 1. In the first process step ridges are in this case introduced into the surface (FIG. 3). This is followed by partial melting of the microstructures (3), caused for example by the application of a flame to the surface. This forms melt droplets, the shape of which is preserved after solidification of the melt (FIG. 2). The microstructures (3) have mushroom-shaped or pushbutton-shaped structures and form undercuts (4).

Further suitable heat processes include in particular laser or plasma flame treatment.

A further variation of the second process step uses a chip-detaching process. In this case, it is critical that some of the chips are detached from the material only incompletely. As a result, the raised microstructures are partly kinked and bent and additional undercuts are generated by the formation of chips. If chip-detaching processes are used for the first and the second process step, the second cut must accordingly be much finer.

The first process step can, depending on the selection of the second step, generate comparatively rough surfaces, for as a rule the second process steps leads to a reduction of the Rz value. Typically the surface roughness is at Rz values in the range of from 20 to 1,000 μm. Preferably Rz values are set in the range of from 20 to 500 μm and particularly preferably the Rz value after the first process step is in the range of from 40 to 100 μm.

Preferably the second process step is carried out in such a way that the coarse depth is reduced. If, for example, rolling is carried out as the second process step, the coarse depth is greatly reduced as a result of the bending-over or kinking of the microstructures. Preferably the second process step leads to a reduction of the surface roughness by at least 30%. Particularly preferably the second process step reduces the Rz value to a range of from 20 to 100 μm.

Figure 5:
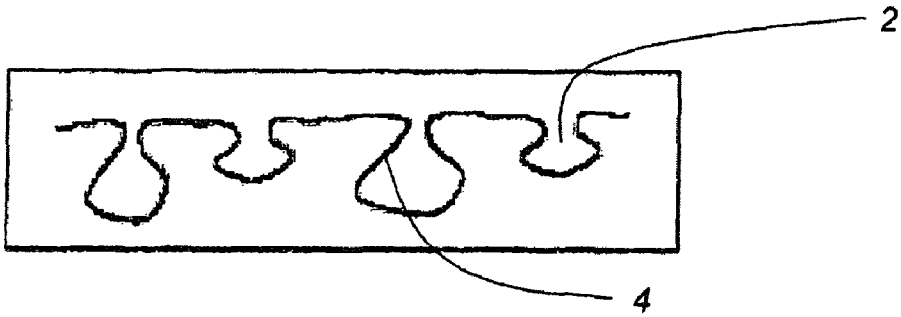
FIG. 5 shows a metallic surface (1) with recesses or depressions (2) with undercuts (4) after the second process step.

In a preferred combination of the first and second process step, recesses are first introduced into the surface by sandblasting and/or high-pressure water jet machining or high-pressure water jet machining with abrasive particles and the recesses are hollowed out in the second process step by high-pressure water jet machining at lower jet energy. Corresponding typical structures after the second process step are illustrated in FIG. 5. Comparable structures can also be obtained for example by the combination of sandblasting and/or high-pressure water jet machining with subsequent pressing, rolling or flame application. Pushbutton-shaped surface structures may in particular be generated as a result.

The second process step may in principle be followed by further process steps. For example, a further reshaping process step can be tagged on to the end of the process.

Preferably the surface treatment is however carried out so as to allow a thermal spray layer (5) to be applied immediately after the second process step. Care must in this case also be taken to ensure the removal of any clinging jet particles or milling residues.

Examples of particularly suitable spraying processes include flame spraying, high-speed flame spraying, sputtering, plasma spraying and arc wire spraying. The processes are distinguished by the deposition of very fine molten or soft droplets or spray particles which can easily infiltrate the undercuts.

The second process step can optionally also be limited to regions of the overall component surface.

A further aspect of the invention relates to components having a roughened surface. A metallic motor vehicle component according to the invention which has a roughened surface and is suitable for the deposition of thermal spray layers has over significant portions of the roughened surface bead-shaped, mushroom-shaped, pushbutton-shaped or hook-shaped raised microstructures in the order of magnitude of from 20 to 400 μm. A significant proportion of the microstructures have in this case undercuts.

In a further configuration according to the invention the metallic motor vehicle components have roughened surfaces which are suitable for the deposition of thermal spray layers, the roughened surface having bowl-shaped or upwardly partly closed recesses and depressions in the order of magnitude of from 20 to 400 μm. The bowls and partly closed structures form undercuts in relation to the component surface.

In a preferred configuration the undercut surface area in the plane parallel to the metal surface is at least 3%. Particularly preferably the undercut surface area is in the range of from 5 to 30%.

A further aspect relates to metallic motor vehicle components having a thermally sprayed tribological or wear protection layer which is deposited on a roughened layer provided with undercuts.

Figure 6:
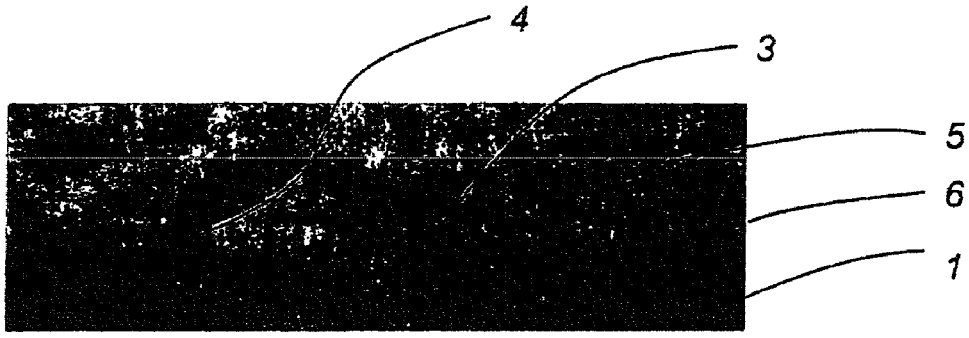
FIG. 6 is a micrograph of a metallic vehicle component transversely to the surface (1) with a thermally sprayed tribological or wear protection layer (5) with a penetration layer (6), microstructures (3) and undercuts (4)

Typical examples of coated components of this type are illustrated in FIG. 6 to 8 as a micrograph transversely to the layer plane. At the base of the tribological or wear protection layer (5) is a penetration layer (6) into which, from the surface (1), bead-shaped, mushroom-shaped, pushbutton-shaped or hook-shaped microstructures (3) having an order of magnitude of from 20 to 400 μm protrude.

To generate the structures according to the diagrams of FIGS. 6 and 7, turning was applied as a first process step, wherein ridges were introduced into the surface. The width of the microstructures is about 20 to 100 μm, the height approx. 30 to 120 μm. The layers (5), which are deposited by means of arc wire spraying, extend so as to cover the entire surface area, even over the undercut regions (14).

The microstructures of the surface according to FIG. 8 were generated by a combination of high-pressure water jet machining with abrasive particles and subsequent high-pressure water jet machining. The layer was deposited by high-speed flame spraying. The structures are considerably finer compared to those of FIGS. 6 and 7.

The invention claimed is:

1. A process for roughening metal surfaces to improve adhesion of layers which are thermally sprayed thereon, wherein in a first process step recesses or depressions (2) are introduced into the surface in a material-detaching or material-removing treatment so that the protruding metal of the surface forms raised microstructures (3), and wherein these microstructures are reworked in at least a second process step by shaping and/or breaking so that a significant proportion of the structures form undercuts (4) in relation to the surface, wherein the second process step involves at least one of (a) rolling, (b) pressing, (c) blasting with solid and/or liquid media, and (d) heat treatment of the surface which leads to melting of the tips of the microstructures.

2. The process as claimed in claim 1, wherein a chip-detaching process, in which some of the chips are detached from the material only incompletely, is used as the second process step.

3. The process as claimed in claim 1, wherein bead-shaped, mushroom-shaped, pushbutton-shaped or hook-shaped raised microstructures are formed by the second process step.

4. The process as claimed in claim 1, wherein the first process step is carried out up to a surface roughness of an Rz value in the range of from 20 to 400 μm.

5. The process as claimed in claim 1, wherein the second process step lowers the surface roughness by at least ⅓.

6. The process as claimed in claim 1, wherein in the first process step ridge structures are introduced, the ridge structures having crests or needle points, and in the second process step the ridge crests or needle points are at least partly kinked, bent over or beveled.

7. The process as claimed in claim 6 wherein the bending-over is carried out in a preferred direction within the plane parallel to the surface.

8. The process as claimed in claim 1, wherein the second process step is carried out by high-pressure water jet machining or high-pressure water jet machining with abrasive particles.

9. The process as claimed in claim 1, wherein recesses are in the first process step introduced into the surface by sand-blasting and/or high-pressure water jet machining and in the second process step hollowed out by high-pressure water jet machining at lower jet energy.

10. The process as claimed in claim 1, wherein a thermal spray layer (5) is applied immediately after the second process step.

11. The process as claimed in claim 1, wherein the raised microstructures (3) formed in the first step are projections, ridges, protuberances or bumps.

12. A process for roughening a metal surface to improve adhesion of layers which are thermally sprayed thereon, wherein in a first process step recesses or depressions (2) are introduced into the metal surface in a material-detaching or material-removing treatment so that protruding metal of the metal surface forms raised microstructures (3), and wherein these microstructures are reworked in at least a second process step by shaping and/or breaking in such a way that only small amounts of material is now removed from the surface and so that a significant proportion of the microstructures form undercuts (4) in relation to the surface, wherein the second process step involves at least one of (a) rolling, (b) pressing, (c) blasting with solid and/or liquid media, and (d) heat treatment of the surface which leads to melting of tips of the microstructures.

13. A process for roughening a metal surface to improve adhesion of layers which are thermally sprayed thereon, wherein in a first process step recesses or depressions (2) are introduced into the metal surface in a material-detaching or material-removing treatment so that protruding metal of the metal surface forms raised microstructures (3), and wherein these microstructures are reworked in at least a second process step by shaping and/or breaking in such a way that no material at all is now removed and so that a significant proportion of the microstructures form undercuts (4) in relation to the surface, wherein the second process step involves at least one of (a) rolling, (b) pressing, (c) blasting with solid and/or liquid media, and (d) heat treatment of the surface which leads to melting of tips of the microstructures.

14. The process as claimed in claim 13, wherein the second process step involves at least one of (a) rolling, (b) pressing, and (c) heat treatment of the surface which leads to melting of the tips of the microstructures.

15. The process as claimed in claim 13, wherein the at least 5% of the raised microstructures have at least one undercut region.

* * * * *